US009138365B2

(12) United States Patent
Deese

(10) Patent No.: US 9,138,365 B2
(45) Date of Patent: Sep. 22, 2015

(54) PATIENT PROTECTIVE SYSTEM FOR AN ADJUSTABLE BED

(71) Applicant: Kenneth A. Deese, Oklahoma City, OK (US)

(72) Inventor: Kenneth A. Deese, Oklahoma City, OK (US)

( * ) Notice: Subject to any disclaimer, the term of this patent is extended or adjusted under 35 U.S.C. 154(b) by 0 days.

(21) Appl. No.: 13/928,116

(22) Filed: Jun. 26, 2013

(65) Prior Publication Data

US 2015/0000040 A1 Jan. 1, 2015

(51) Int. Cl.

| | |
|---|---|
| ***A47C 20/00*** | (2006.01) |
| ***A61G 7/05*** | (2006.01) |
| ***A47D 15/00*** | (2006.01) |

(52) U.S. Cl.

CPC ..... *A61G 7/0507* (2013.01); *A47D 15/008* (2013.01); *A61G 7/0506* (2013.01); *A61G 7/0525* (2013.01); *A61G 2007/0515* (2013.01); *A61G 2007/0522* (2013.01)

(58) Field of Classification Search

CPC ..... A61G 7/0507; A61G 2007/0522; A61G 7/05; A61G 2007/0513; A47C 21/08

USPC ..... 5/100, 424–430, 663, 946

See application file for complete search history.

(56) References Cited

U.S. PATENT DOCUMENTS

| | | | | |
|---|---|---|---|---|
| 4,672,698 | A * | 6/1987 | Sands | 5/424 |
| 5,481,772 | A * | 1/1996 | Glynn et al. | 5/663 |
| 5,575,025 | A * | 11/1996 | Peters | 5/600 |
| 6,347,422 | B2 * | 2/2002 | Heavrin | 5/663 |
| 6,393,639 | B1 * | 5/2002 | Ohsner | 5/425 |
| 6,721,974 | B1 * | 4/2004 | Wilkinson | 5/425 |
| 6,952,847 | B1 * | 10/2005 | Cleary | 5/430 |
| 7,007,323 | B2 * | 3/2006 | Zerhusen et al. | 5/427 |
| 7,246,388 | B2 * | 7/2007 | DiLiberto, Jr. | 5/425 |
| 7,549,183 | B2 * | 6/2009 | Dockendorf et al. | 5/655 |
| 7,784,123 | B2 * | 8/2010 | Long et al. | 5/424 |
| 7,784,124 | B2 * | 8/2010 | Long et al. | 5/424 |
| 8,413,274 | B2 | 4/2013 | Weismiller et al. | |
| 8,424,135 | B2 | 4/2013 | Serhan | |
| 8,484,773 | B2 | 7/2013 | Blevins et al. | |
| 8,505,134 | B2 | 8/2013 | Poyet | |
| 8,512,222 | B2 | 8/2013 | Millman | |
| 8,516,637 | B2 | 8/2013 | Karwal et al. | |
| 2001/0044970 | A1 * | 11/2001 | Heavrin | 5/663 |
| 2005/0071921 | A1 * | 4/2005 | Risk, Jr. | 5/425 |
| 2005/0108825 | A1 * | 5/2005 | Tayoun, Jr. | 5/663 |

* cited by examiner

*Primary Examiner* — Timothy D Collins

*Assistant Examiner* — Richard G Davis

(74) *Attorney, Agent, or Firm* — Hall Estill Attorneys at Law

(57) ABSTRACT

A patient protective system that preferably includes at least an adjustable bed providing a bed frame, and a side rail in sliding communication with the bed frame and a mattress supported by the bed frame. The patient protective system further preferably includes a side impact absorbing pad supported by the mattress and in contact adjacency with the side rail a patient access flap secured to the side impact absorbing pad and attached to the mattress, and a patient head entrapment impediment secured to the side impact absorbing pad and the mattress.

20 Claims, 12 Drawing Sheets

PATIENT PROTECTIVE SYSTEM FOR AN ADJUSTABLE BED

FIELD OF THE INVENTION

The claimed invention relates to the field of patient protection systems, and more particularly to a patient protective system for an adjustable bed.

SUMMARY OF THE INVENTION

In accordance with various exemplary embodiments, a patient protective system that preferably includes at least an adjustable bed providing a bed frame, and a side rail in sliding communication with the bed frame, and a mattress supported by the bed frame. The patient protective system further preferably includes a side impact absorbing pad supported by the mattress and in contact adjacency with the side rail a patient access flap secured to the side impact absorbing pad and attached to the mattress, and a patient head entrapment impediment secured to the side impact absorbing pad and the mattress.

These and various other features and advantages that characterize the claimed invention will be apparent upon reading the following detailed description and upon review of the associated drawings.

DETAILED DESCRIPTION OF AN EXEMPLARY EMBODIMENT OF THE DRAWINGS

Reference will now be made in detail to one or more examples of various embodiments of the present invention depicted in the figures. Each example is provided by way of explanation of the various embodiments of the present invention, and not meant as a limitation of the invention. For example, features illustrated or described as part of one embodiment may be used with another embodiment to yield still a different embodiment. Other modifications and variations to the described embodiments are also contemplated within the scope and spirit of the claimed invention.

Figure 1:
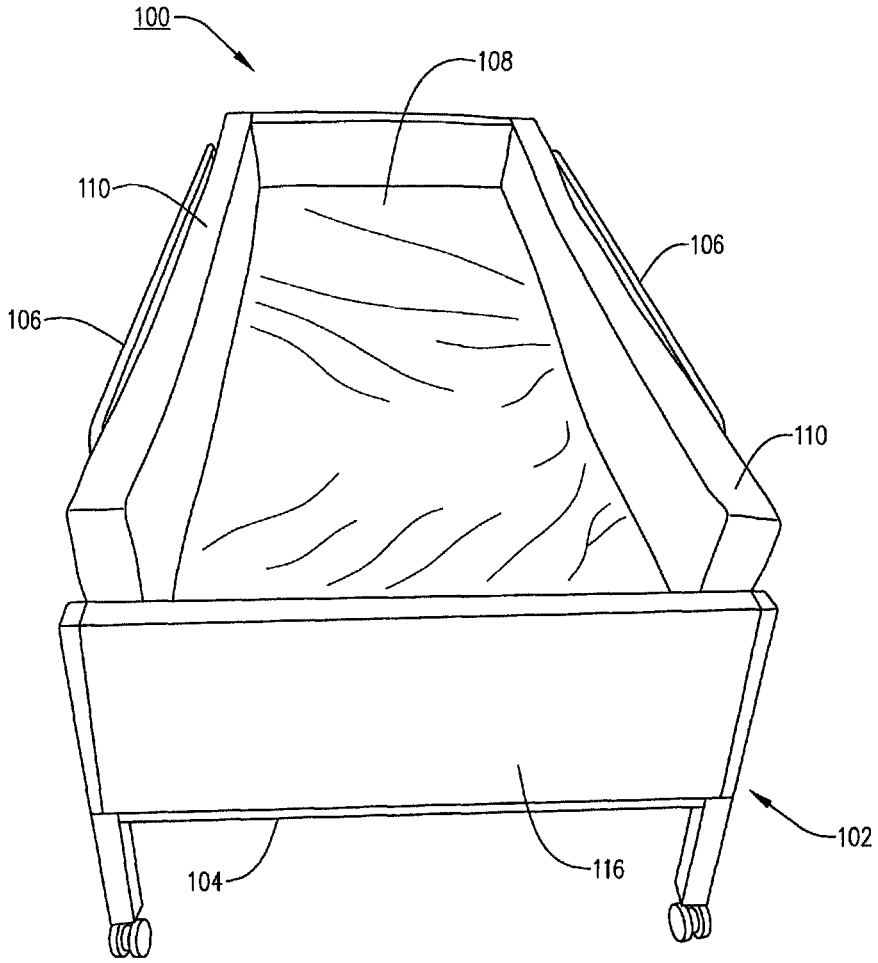
FIG. 1 displays a top orthogonal projection of an exemplary embodiment of a patient protective system for an adjustable bed.
Figure 4:
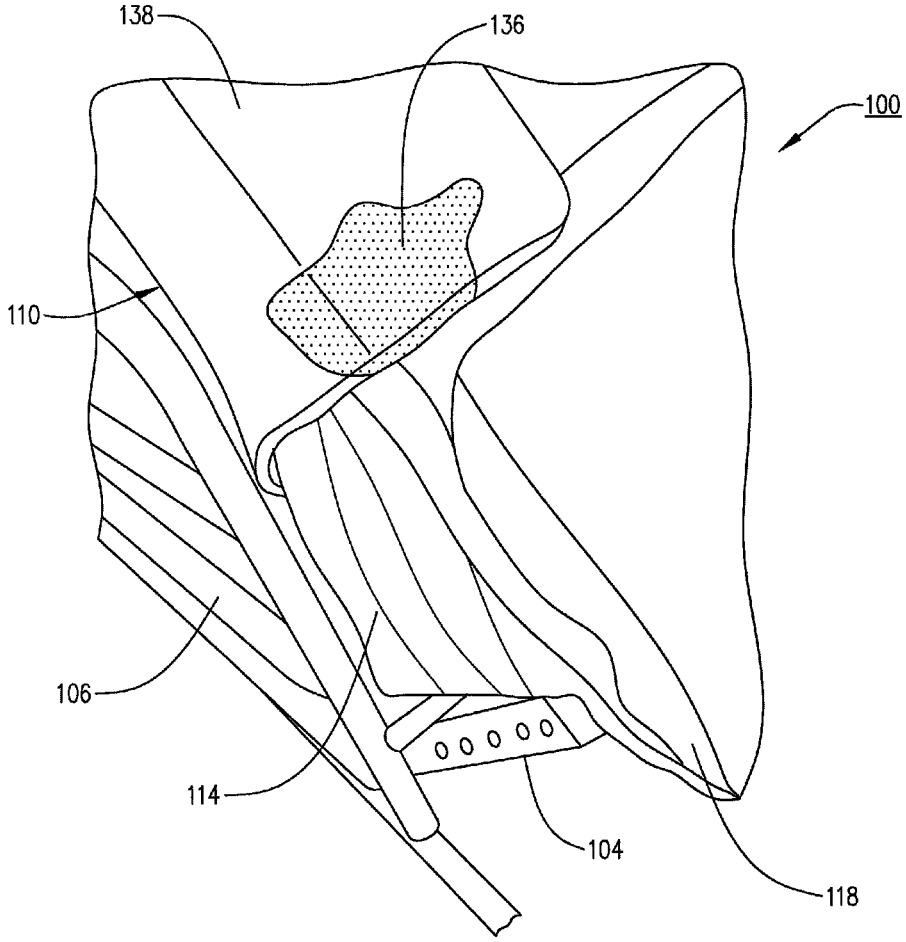
FIG. 4 illustrates a top orthogonal projection of a patient entrapment impediment secured to the side impact absorption pad and the head impact absorption pad.

Turning to the drawings, FIG. 1 displays an exemplary embodiment of a patient protective system 100, for an adjustable bed 102. In a preferred embodiment, the patient protective system 100 includes at least, but is not limited to, the adjustable bed 102 providing a bed frame 104. Preferably, the patient protective system 100 further includes a side rail 106, in sliding communication with the bed frame 104, a mattress 108 supported by the bed frame 104, and a side impact absorbing pad 110, supported by the mattress 108 and in contact adjacency with the side rail 106. The side impact absorbing pad 110 mitigates injury of a patient contacting the side rail 106. The preferred embodiment further includes a patient access flap 112, (of FIG. 12) secured to the side impact absorbing pad 110 and attached to the mattress 108, and a patient head entrapment impediment 114 (of FIG. 4), secured to the side impact absorbing pad 110, and the mattress 108. The patient head entrapment impediment 114 mitigates entrapment of the patient's head between a headboard 116 (of FIG. 4), and the side rail 106 (of FIG. 4), while the patient access flap 112, promotes easy ingress and egress of the patient onto and off of the mattress 108.

Figure 2:
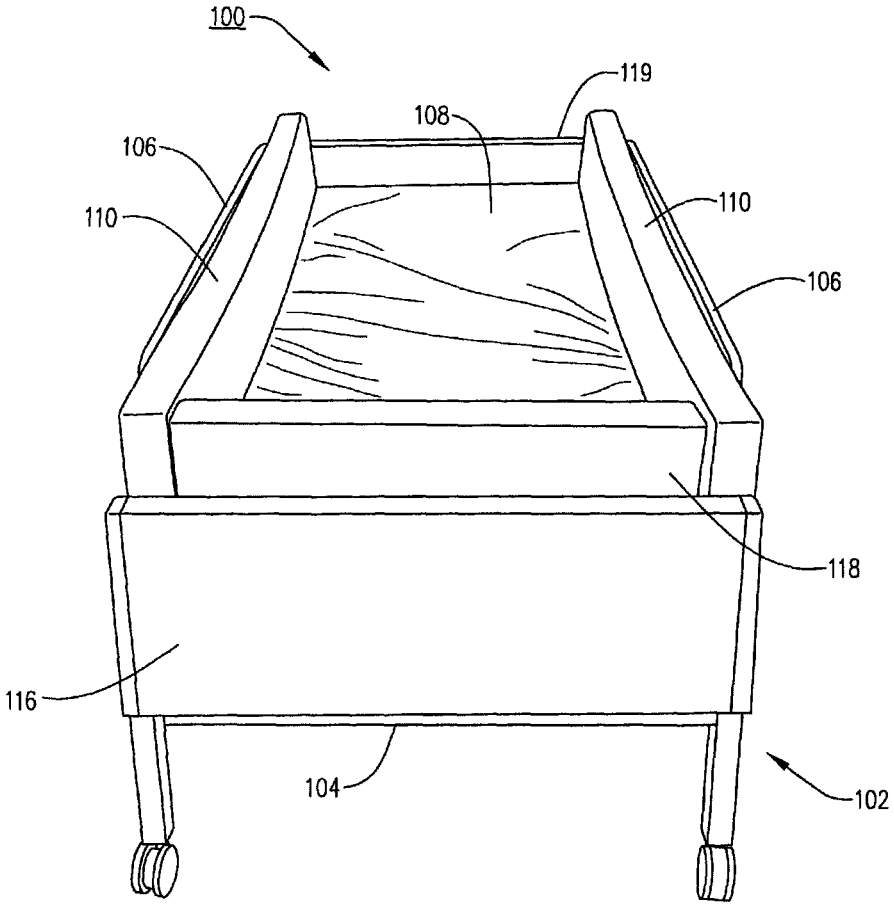
FIG. 2 shows an alternate top orthogonal projection of the exemplary embodiment of the patient protective system for the adjustable bed of FIG. 1.

FIG. 2 shows the preferred embodiment further includes a head impact absorption pad 118, supported by the mattress 108, in contact adjacency with the headboard 116, and disposed between the side impact absorption pads 110. The head impact absorption pad 118, mitigates injury of the patient head contacting the head board 116. FIG. 2 further shows a footboard 119, distal from the headboard 116, and disposed between the side impact absorbing pads 110.

Figure 3:
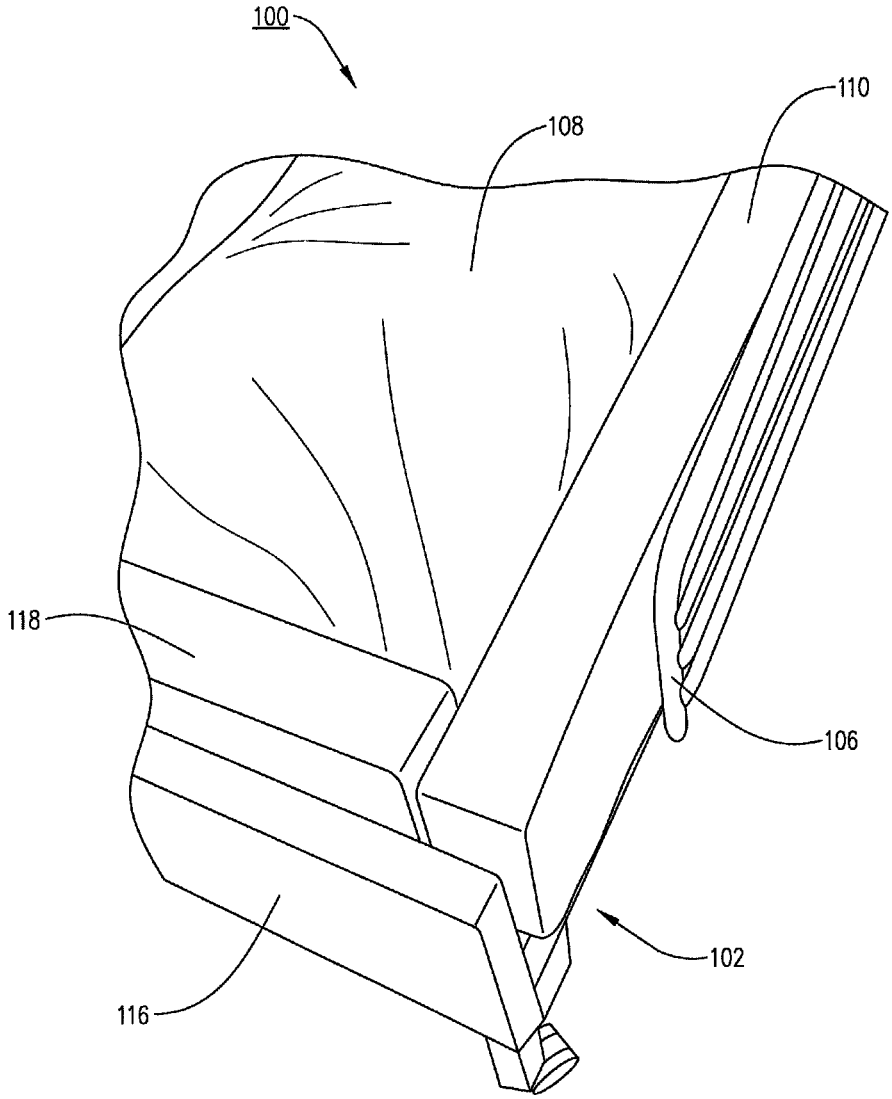
FIG. 3 reveals a top orthogonal projection of an exemplary embodiment of a patient protective system for an adjustable bed of FIG. 1, showing the interaction between a side impact absorption pad and a head impact absorption pad.
Figure 5:
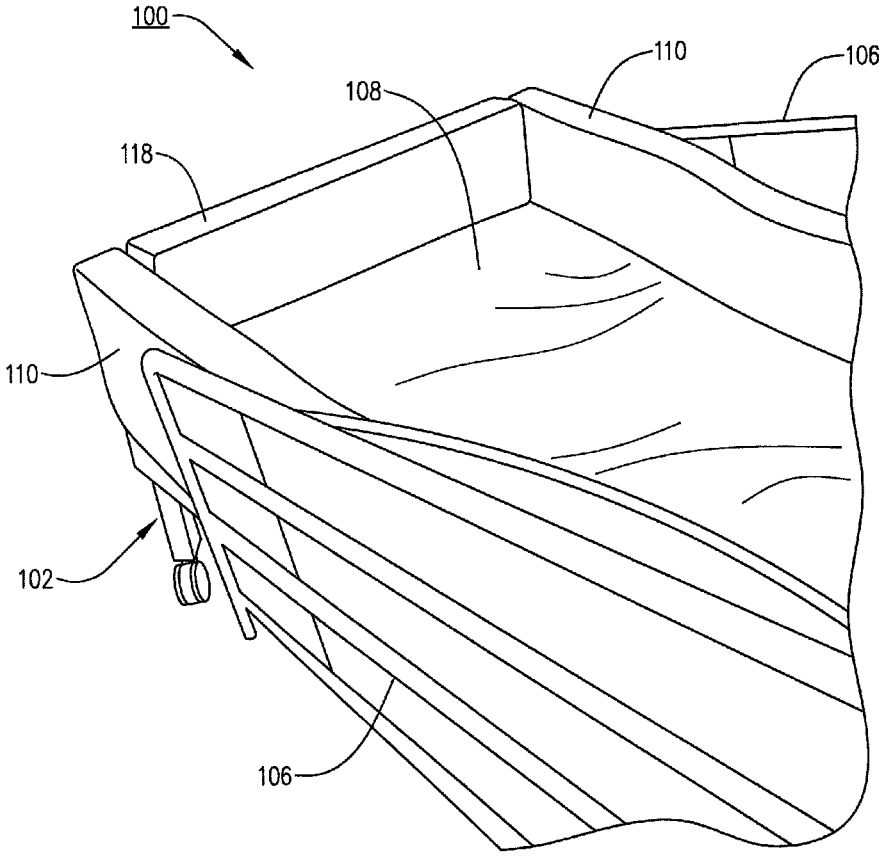
FIG. 5 provides a side orthogonal projection of the adjustable bed of FIG. 1 with the foot of the bed in a raised position.

FIG. 3 of a preferred embodiment of the patient protective system 100, for an adjustable bed 102 shows a better perspective of the relative position of the headboard 116, to the side impact absorptions pads 110, the head impact absorption pad 118, and the side rail 106, hue FIG. 5 shows the side impact absorption pads 110, maintain their position relative to the side rails 106, when the foot portion of the adjustable bed 102 is raised.

Figure 6:
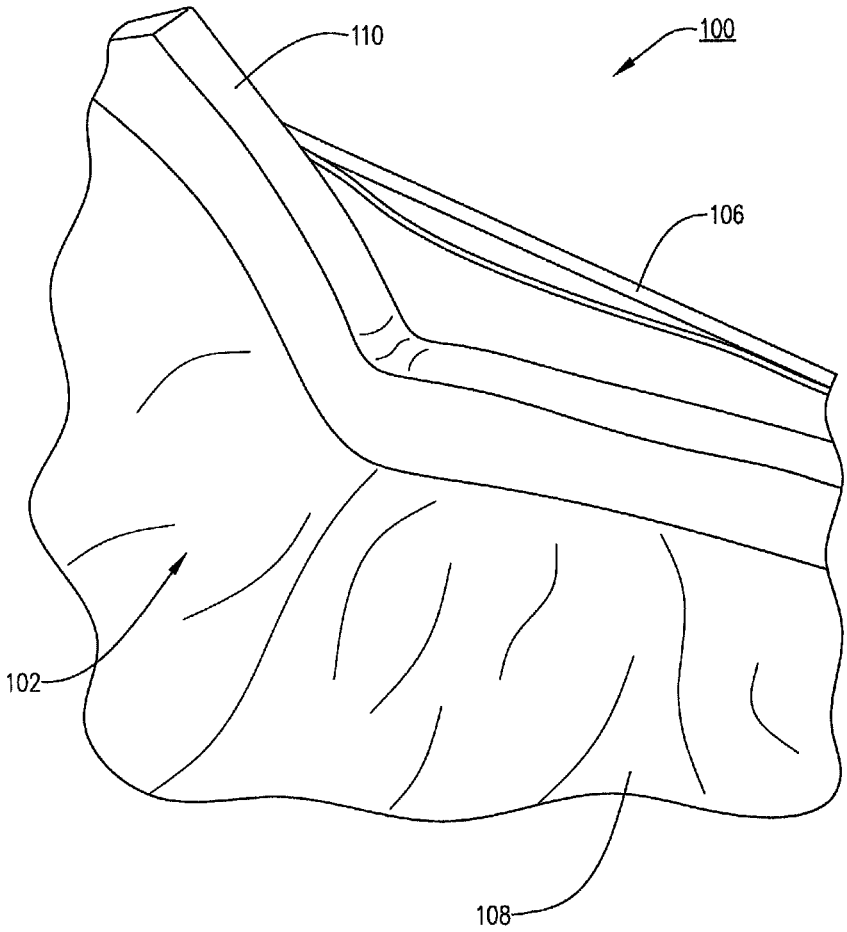
FIG. 6 displays a side orthogonal projection of the adjustable bed of FIG. 1 with the head of the bed in a raised position.

FIG. 6 of a preferred embodiment of the patient protective system 100, for an adjustable bed 102 shows that the side impact absorption pads 110, maintain their position relative to the side rails 106, when the head portion of the adjustable bed 102 is raised.

Figure 7:
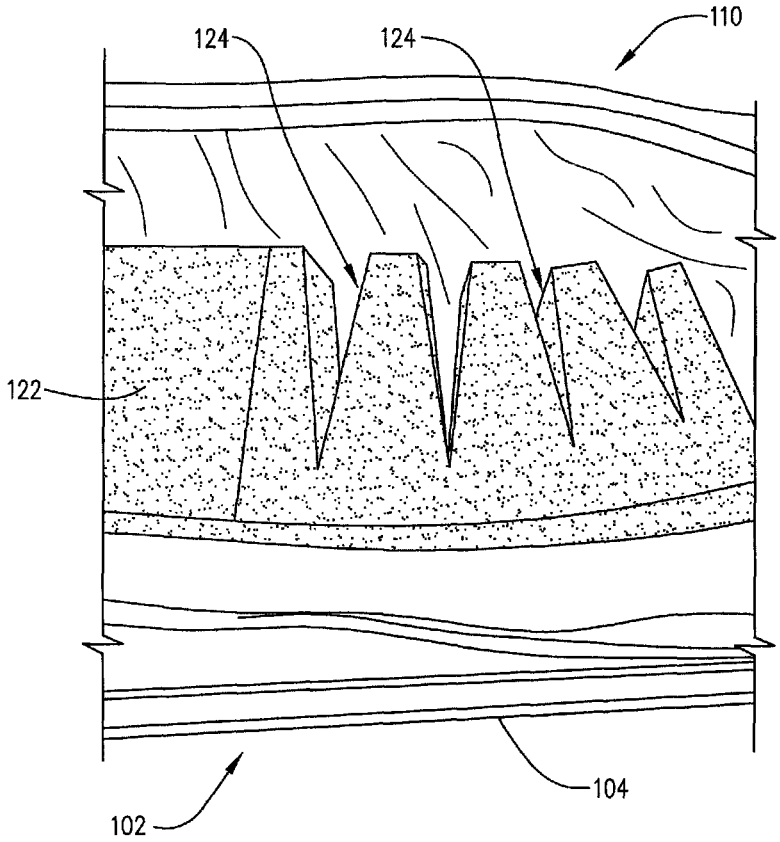
FIG. 7 shows a side view in elevation of a plurality of position compliant notches provided by compressible resilient polymer core of the side impact absorbing pad.

FIG. 7 reveals that a preferred embodiment of the side impact absorption pads 110 include an external compliant cover 120, enclosing a shape resilient polymer core 122. The shape resilient polymer core 122 preferably provides a plurality of mattress position compliant notches 124, which accommodate adjustments of the foot or head portions of the adjustable bed 102, to assure a consistent barrier of protection is provided to the patient by the side impact absorption pads 110.

Figure 8:
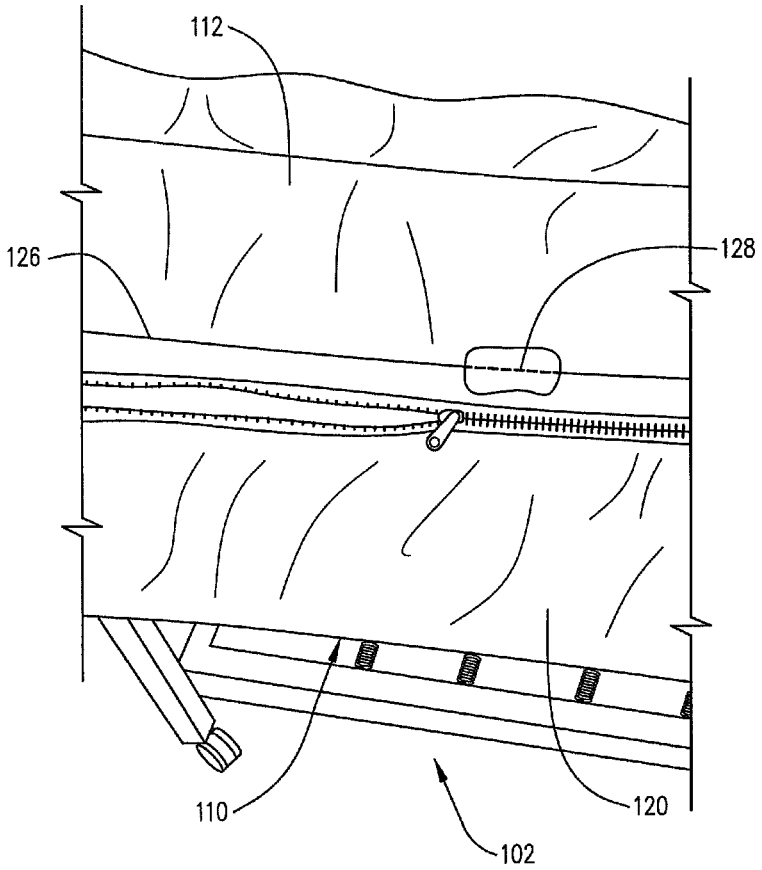
FIG. 8 illustrates a side view in elevation of a zipper accessible access aperture for the compressible resilient polymer core of the side impact absorbing pad of FIG. 7.

FIG. 8 shows that in a preferred embodiment of the side impact absorption pads 110, the patient access flap 112 is attached to the external compliant cover 120 by way of a mechanical structure 126. The mechanical structure suitable for the attachment may include, but is not limited to: buttons, zippers, hook and loop fasteners, snaps, hook and eye, eyelets and lacing, fabric rivets as well as other fastening structures know in the art. However, in a preferred embodiment the fastening method of choice is stitching 128.

Figure 9:
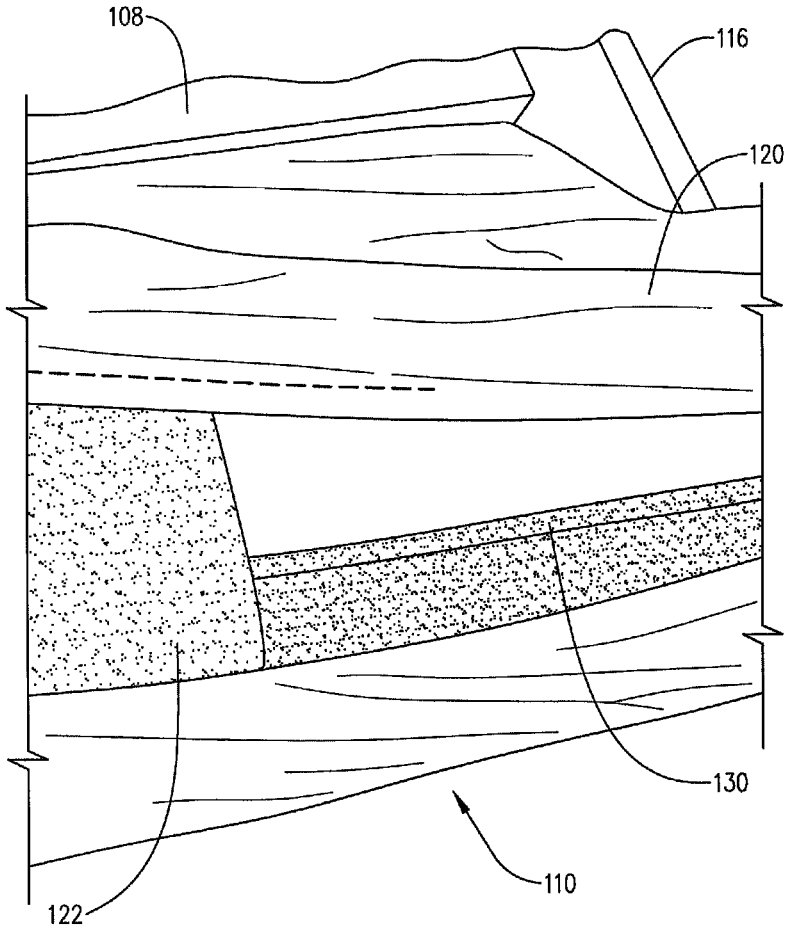
FIG. 9 provides top plan view of a shape retention member attached to the compressible resilient polymer core.

FIG. 9 illustrates that in a preferred embodiment of the side impact absorption pads 110, a shape retention member 130, is provided in contact adjacency with the shape resilient polymer core 122. In a preferred embodiment, the shape retention member 130, is formed from a quasi ridged polymer, having an ability to flex while resisting a compressive load. The shape retention member 130 is preferably disposed within the external compliant cover 120, and adjacent each the head and foot portion of the mattress 108. Preferably, the shape retention member 130 assures a consistent presentation of the side impact absorption pads 110 to the patient during the raising and lowering of the the foot or head portions of the adjustable bed 102.

Figure 10:
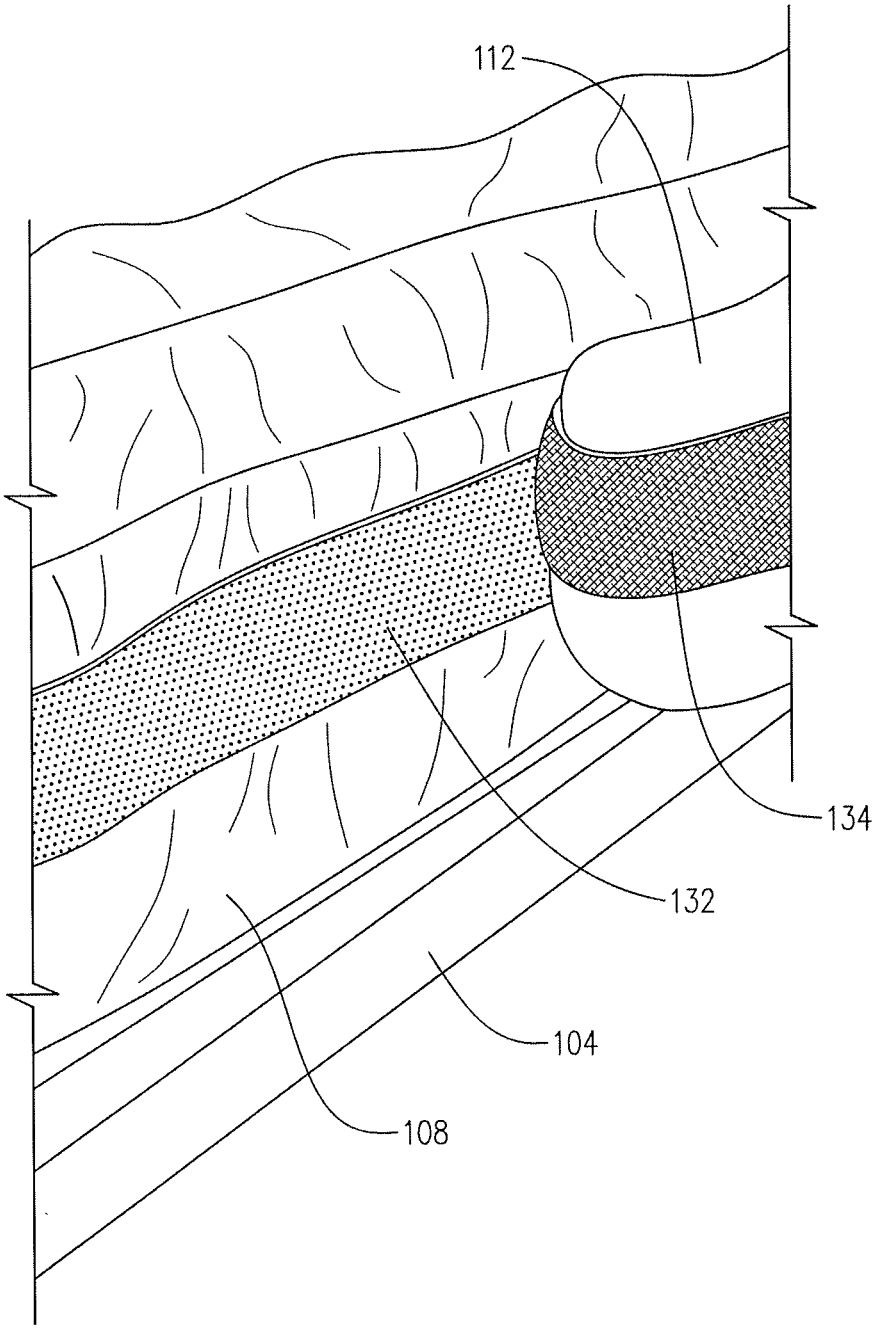
FIG. 10 displays an orthogonal view in elevation of a loop portion of a hook and loop system attached to the mattress.

FIG. 10 shows that in a preferred embodiment, the mattress 108 provides an attachment feature 132, which interacts with a fastening feature 134 of the patient access flap 112. Preferably, the attachment feature 132 is offset from the edge of the edge of the mattress 108, to facilitate the placement of sheets onto the mattress 108, without the need to detach the side impact absorption pads 110 from the mattress 108. Additionally, in a preferred embodiment, each of the side impact absorption pads 110, and the head impact absorption pad 118, are likewise secured to the mattress 108. In a preferred embodiment the attachment feature 132 is a hook portion of a hook and loop fastening system, else a loop portion of the hook and loop fastening system, and the corresponding fastening feature 134 is a loop portion of a hook and loop fastening system, else a hook portion of the hook and loop fastening system.

Returning to FIG. 4, the head impact absorption pad preferably includes at least a compressible resilient polymer core 136, and an external compliant cover 138 enclosing the compressible resilient polymer core 136.

Figure 11:
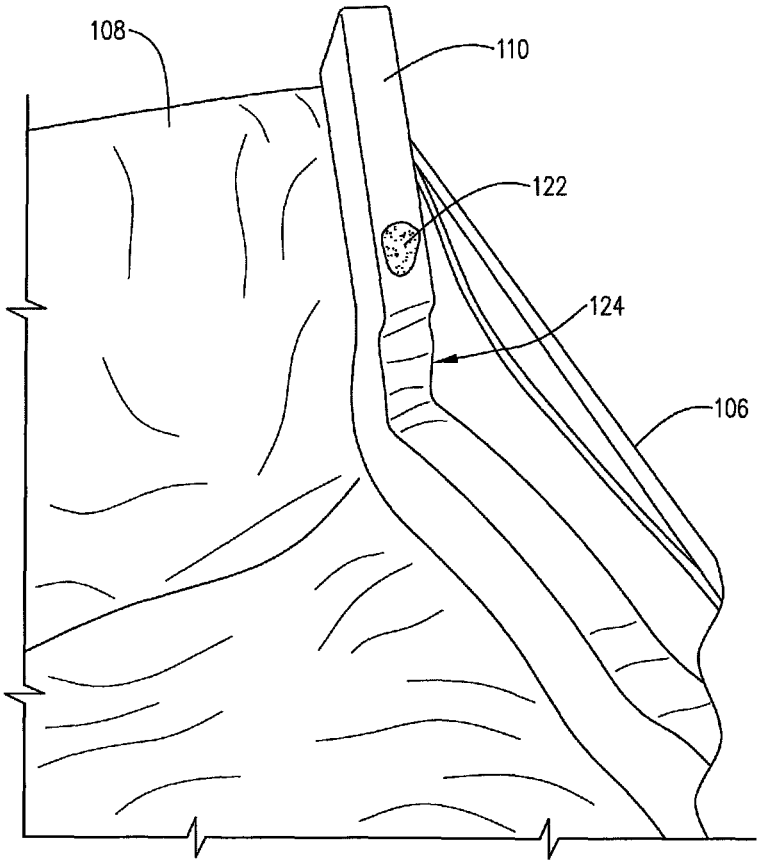
FIG. 11 shows a side orthogonal projection of the adjustable bed of FIG. 1 with the foot of the bed in a fully raised position.

FIG. 11 shows the foot portion of the mattress 108 in a fully raised position, and the side impact absorption pad 110 maintaining its position relative to the mattress 108, via the functioning of the of mattress position compliant notches 124, of the shape resilient polymer core 122.

Figure 12:
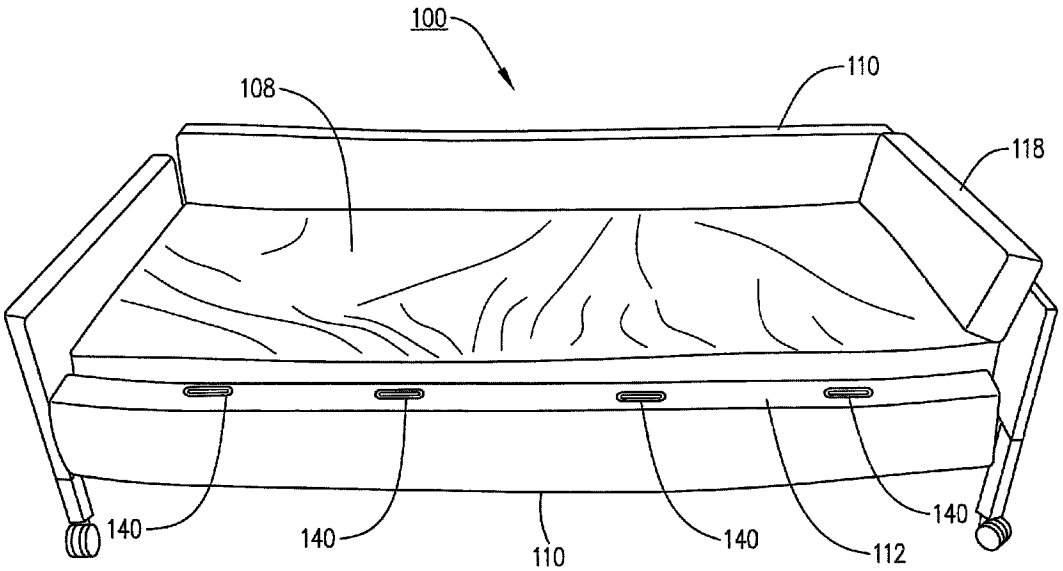
FIG. 12 illustrates a view in elevation of a plurality of patient retention strap apertures provided by the patient access flap.

FIG. 12 reveals a plurality of patient retention strap apertures 140 provides by the patient access flap 112. In a preferred embodiment, the patient retention strap apertures 140 are organized such that patient retention straps may pass through the patient retention strap apertures 140, beneath the mattress 108 in a manner that does not interfere with the changing of the sheets of the mattress. Preferably, each patient access flap 112, is interchangeable one with the other, and each of the side impact absorption pad 110 are interchangeable one with the other.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present claimed invention to the full extent indicated by the broad general meaning of the terms in which the appended claims are expressed. For example, the particular elements may vary depending on the particular application without departing from the spirit and scope of the present claimed invention.

It will be clear that the present invention is well adapted to attain the ends and advantages mentioned as well as those inherent therein. While presently preferred embodiments have been described for purposes of this disclosure, numerous changes may be made which will readily suggest themselves to those skilled in the art and which are encompassed by the appended claims.

What is claimed is:

1. A patient protective system comprising:

an adjustable bed providing a bed frame;

a side rail in sliding communication with the bed frame;

a mattress supported by the bed frame;

a side impact absorbing pad supported by the mattress and in contact adjacency with the side rail;

a patient access flap mechanically attached to the side impact absorbing pad and mechanically attached to the mattress by way of a patient access flap mechanical attachment, said patient access flap mechanical attachment is offset from an edge of the mattress such that a sheet may be placed on the mattress without the need to detach the side impact absorbing pad from the mattress; and a patient head entrapment, impediment secured to the side impact absorbing pad and the mattress.

2. The patient protective system of claim 1, in which the adjustable bed further providing a head board, and further comprising a head impact absorption pad supported by the mattress and in contact adjacency with the head board.

3. The patient protective system of claim 2, in which the side impact absorbing pad is a first side impact absorbing pad, the side rail is a first side rail, and further comprising a second side rail in sliding communication with the bed frame, and a second side impact absorbing pad supported by the mattress and in contact adjacency with the side rail.

4. The patient protective system of claim 3, in which the patient head entrapment impediment is a first patient head entrapment impediment, the first head entrapment impediment secured to the first side impact absorbing pad, and further comprising a second patient head entrapment impediment secured to the second side impact absorbing pad and the mattress.

5. The patient protective system of claim 4, in which the head impact absorption pad is disposed between the first and second side impact absorbing pads and linked to each the first and second patient head entrapment impediments.

6. The patient protective system of claim 5, in which the patient access flap is a first patient access flap attached to the first side impact absorption pad, and further comprising and second patient access flap attached to the second side impact absorption pad.

7. The patient protective system of claim 6, in which the first and second patient access flaps are attached to their respective side impact absorption pads by way of a mechanical structure.

8. The patient protective system of claim 7, in which the mechanical structure is stitching.

9. The patient protective system of claim 8, in which the mattress provides a first attachment feature interacting with a fastening feature of the first patient access flap.

10. The patient protective system of claim 9, in which the mattress provides a second attachment feature interacting with a fastening feature of the second patient access flap.

11. The patient protective system of claim 10, in which the mattress provides a third attachment feature interacting with a fastening feature of the head impact absorption pad.

12. The patient protective system of claim 11, in which each the first, second, and third attachment feature is a hook component of a hook and loop fastening system, else a loop component of a hook and loop fastening system.

13. The patient protective system of claim 12, in which each the fastening feature of the first patient access flap, the fastening feature of the second patient access flap, and the fastening feature of the head impact absorption pad is a corresponding loop component of the hook and loop fastening system, else a corresponding hook component of the hook and loop fastening system.

14. The patient protective system of claim 7, in which the patient access flap is a first patient access flap secured to the first side impact absorption pad and further comprising a second patient access flap secured to the second side impact absorption pad, wherein each the first and second patient access flaps are secured to their respective side impact absorption pads by way of a mechanical means for securing, each said patient access pads to their corresponding side impact absorption pads.

15. The patient protective system of claim of claim 14, in which the mechanical means for securing each said patient access pads to their corresponding side impact absorption pads is a zipper, else snaps, else sets of hook and eye fasteners, else buttons.

16. The patient protective system of claim of claim 15, in which each first and second patient access flap provides a plurality of patient retention strap apertures, and wherein each patient access flap is interchangeable one with the other.

17. The patient protective system of claim 1, in which the side impact absorbing pad comprising;

a compressible resilient polymer core;

a shape retention member attached to the compressible resilient polymer core; and an external compliant cover enclosing the compressible resilient polymer core with attached shape retention member.

18. The patient protective system of claim 17, in which the side impact absorbing pad is a first side impact absorbing pad, and further comprising as second side impact absorbing pad, the second impact absorbing pad comprising;

a compressible resilient polymer core;

a shape retention member attached to the compressible resilient polymer core; and an external compliant cover enclosing the compressible resilient polymer core with attached shape retention member.

19. The patient protective system of claim 18, further comprising a head impact absorption pad disposed between the first and second side impact absorbing and supported by the mattress, the head impact absorption pad comprising:

a compressible resilient polymer core; and an external compliant cover enclosing the compressible resilient polymer core.

20. The patient protective system of claim 19, in which each the first and second side impact absorption pads provide mattress position compliant notches, said notches maintain a consistent vertical relationship between the mattress and a top surface of each the first and second side impact absorption pads.

* * * * *